US007500923B2

(12) United States Patent
Tateno

(10) Patent No.: US 7,500,923 B2
(45) Date of Patent: Mar. 10, 2009

(54) PUTTER HEAD

(75) Inventor: Atsuo Tateno, Ichikawa (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 127 days.

(21) Appl. No.: 11/474,413

(22) Filed: Jun. 26, 2006

(65) Prior Publication Data

US 2007/0099724 A1 May 3, 2007

(30) Foreign Application Priority Data

Oct. 31, 2005 (JP) ..... P2005-317141

(51) Int. Cl.
*A63B 53/04* (2006.01)

(52) U.S. Cl. ..... 473/329; 473/332; 473/340; 473/349

(58) Field of Classification Search ..... 473/324–350
See application file for complete search history.

(56) References Cited

U.S. PATENT DOCUMENTS

| | | | | | |
|---|---|---|---|---|---|
| 564,655 | A * | 7/1896 | Slade | 473/342 |
| 699,624 | A * | 5/1902 | Kemphall | 473/329 |
| 700,946 | A * | 5/1902 | Kempshall | 473/329 |
| 708,575 | A * | 9/1902 | Mules | 473/329 |
| 819,900 | A * | 5/1906 | Martin | 473/329 |
| 1,562,956 | A * | 11/1925 | Guerne | 473/329 |
| 2,034,936 | A * | 3/1936 | Barnhart | 473/329 |
| 3,975,023 | A * | 8/1976 | Inamori | 473/329 |
| 4,422,638 | A * | 12/1983 | Tucker | 473/329 |
| 4,681,322 | A * | 7/1987 | Straza et al. | 473/329 |
| 4,884,812 | A * | 12/1989 | Nagasaki et al. | 473/342 |
| 4,928,965 | A * | 5/1990 | Yamaguchi et al. | 473/332 |
| 5,083,778 | A * | 1/1992 | Douglass | 473/329 |
| 5,358,249 | A * | 10/1994 | Mendralla | 473/331 |
| 5,398,929 | A * | 3/1995 | Kitaichi | 473/329 |
| 5,403,007 | A * | 4/1995 | Chen | 473/342 |
| 5,405,136 | A * | 4/1995 | Hardman | 473/342 |
| 5,489,094 | A * | 2/1996 | Pritchett | 473/342 |
| 5,497,993 | A * | 3/1996 | Shan | 473/329 |
| 5,542,675 | A * | 8/1996 | Micciche et al. | 473/329 |
| 5,766,093 | A * | 6/1998 | Rohrer | 473/329 |
| 5,921,871 | A * | 7/1999 | Fisher | 473/329 |
| 6,001,030 | A * | 12/1999 | Delaney | 473/329 |
| 6,200,229 | B1 * | 3/2001 | Grace et al. | 473/324 |
| 6,227,986 | B1 * | 5/2001 | Fisher | 473/342 |
| 6,238,303 | B1 * | 5/2001 | Fite | 473/342 |
| 6,270,423 | B1 * | 8/2001 | Webb | 473/226 |
| 6,302,807 | B1 * | 10/2001 | Rohrer | 473/329 |

(Continued)

FOREIGN PATENT DOCUMENTS

JP 2004-236985 A 8/2004

(Continued)

*Primary Examiner*—Sebastiano Passaniti
(74) *Attorney, Agent, or Firm*—Sughrue Mion, PLLC

(57) ABSTRACT

A putter head that includes: a head body having a face portion; and a face insert fitted in the face portion, the face insert including a high-hardness portion that forms a hitting surface, a low-hardness portion jointed to the high-hardness portion and having a hardness lower than that of the high-hardness portion, and a projecting portion formed at least on a central portion of the high-hardness portion, the low-hardness portion filling a recessed portion formed by the projecting portion.

15 Claims, 6 Drawing Sheets

U.S. PATENT DOCUMENTS 6,592,467 B1 * 7/2003 Gray ..... 473/332
6,743,117 B2 * 6/2004 Gilbert ..... 473/332
7,115,041 B2 * 10/2006 Guard et al. ..... 473/251
7,144,335 B2 * 12/2006 Breier et al. ..... 473/340
7,261,644 B2 * 8/2007 Burrows ..... 473/340
7,273,420 B2 * 9/2007 Wright ..... 473/329

FOREIGN PATENT DOCUMENTS

JP 2005-124730 A 5/2005

* cited by examiner

PUTTER HEAD

BACKGROUND OF THE INVENTION

1. Field of the Invention

The present invention relates to a putter head with a face insert fitted in a face portion of a head body.

2. Description of the Related Art

Conventionally, a putter head has been proposed in which a face insert made of a material different from that of a head body is fitted in a face portion of the head body. For example, JP-A-2004-236985 discloses a putter head in which a face insert having a layered structure integrally including a rubber elastic body layer, a sintered metal layer, and a fluororesin layer is fitted in the face portion of the head body. In addition, JP-A-2005-124730 discloses a putter head in which an elastic body-made face insert whose thickness increases gradually from the side of the vicinity of a sweet spot of the head toward a peripheral edge side is fitted in a face portion of a head body.

SUMMARY OF THE INVENTION

The above-described putter head with the face insert fitted in the head body is generally aimed at softening the hitting sensation when the ball is hit by the face insert.

However, with the conventional putter head with the face insert fitted in the head body, while the hitting sensation can be made soft by the face insert, the hitting sound becomes dull (low), so that there have been cases where it is difficult to grasp a sense of distance of the putt.

One aspect of the present invention provides a putter head with a face insert fitted in a head body, in which the hitting sensation at the time of hitting a ball is soft and the hitting sound is hard (high), so that it is easy to grasp the sense of distance of the putt.

According to an aspect of the invention, there is provided a putter including: a head body having a face portion; and a face insert fitted in the face portion, the face insert including a high-hardness portion that forms a hitting surface, a low-hardness portion jointed to the high-hardness portion and having a hardness lower than that of the high-hardness portion, and a projecting portion formed at least on a central portion of the high-hardness portion, the low-hardness portion filling a recessed portion formed by the projecting portion.

In the above putter head, since the hardness of the high-hardness portion for forming the hitting surface (the surface for directly hitting the golf ball) is high, it is possible to obtain a hard (high) hitting sound by means of this high-hardness portion. Accordingly, it is easy to grasp the sense of distance of the putt. In addition, since the hardness of the low-hardness portion joined to the high-hardness portion is lower than that of the high-hardness portion, a soft hitting sensation is obtained by this low-hardness portion.

Hereafter, a more detailed description will be given of the aspect of the invention. In the aspect, as the material of the head body, it is possible to cite, for example, stainless steel, aluminum, an aluminum alloy, brass, steel, a titanium alloy, zinc, a carbon fiber-reinforced resin, and the like, but the material of the head body is not limited to the same.

In addition, as the materials of the high-hardness portion and the low-hardness portion of the face insert, it is possible to cite synthetic resins such as an ionomer resin, a urethane resin, a urethane-based elastomer, and a polyester-based elastomer, and rubbers such as a styrene-butadiene rubber and a butadiene rubber, but the materials of the high-hardness portion and the low-hardness portion of the face insert are not limited to the same. As the materials of the high-hardness portion and the low-hardness portion of the face insert, elastomers such as a urethane-based elastomer and a polyester-based elastomer and urethane resins are particularly preferable.

In the aspect, it is preferred that the Shore D hardness of the high-hardness portion be set to 30 or more, particularly 35 to 100, that the Shore D hardness of the low-hardness portion be set to 10 or more, particularly 15 to 60, and that the difference in the Shore D hardness between the high-hardness portion and the low-hardness portion be set to 5 or more, particularly 10 to 85. If the Shore D hardness of the high-hardness portion is less than 30, there are cases where a hard hitting sound cannot be obtained. If the Shore D hardness of the low-hardness portion is less than 10, there are cases where a soft hitting sensation cannot be obtained. If the difference in the Shore D hardness between the high-hardness portion and the low-hardness portion is less than 5, there are cases where the advantages of the aspect of making the hitting sensation soft and making the hitting sound hard cannot be obtained.

In the aspect, one or both of the high-hardness portion and the low-hardness portion can be provided with a multi-layered structure. In a case where only the high-hardness portion is provided with the multi-layered structure, the Shore D hardness of an outermost layer which comes into contact with the golf ball in the high-hardness portion and the difference in hardness between the outermost layer and the low-hardness portion are set to the aforementioned values. In a case where only the low-hardness portion is provided with the multi-layered structure, the Shore D hardness of an innermost layer which adjoins the head body in the low-hardness portion and the difference in hardness between the innermost layer and the high-hardness portion are set to the aforementioned values. In a case where both of the high-hardness portion and the low-hardness portion are provided with a multi-layered structure, the Shore D hardness of the outermost layer that comes into contact with the golf ball in the high-hardness portion, the Shore D hardness of the innermost layer which adjoins the head body in the low-hardness portion, and the difference in hardness between the outermost layer of the high-hardness portion and the innermost layer of the low-hardness portion are set to the aforementioned values.

In the aspect, a projecting portion is formed at least on the central portion of the inner surface of the high-hardness portion, and the low-hardness portion is joined to the inner surface of the high-hardness portion so as to fill a recessed portion formed by the projecting portion. In this case, the projecting portion may be formed only on the central portion of the inner surface of the high-hardness portion, or the projecting portion may be formed on both of the central portion and its peripheral portions. It should be noted that, in the aspect, the aforementioned phrase "central portion" refers to a central region when widthwise direction (toe-heel direction) of the high-hardness portion is divided equally into three parts, and the phrase "peripheral portions" refers to its both lateral regions. In addition, in the aspect, in a case where a frame-like body is provided projectingly along peripheral edges of the high-hardness portion as in embodiments which will be described later, it is construed that this frame-like body is not included in the projecting portion. This is because, when putting, the golf ball is normally not hit by the peripheral edge of the high-hardness portion.

The shape of the aforementioned projecting portion is not limited, and may be formed into an arbitrary shape including, for example, a cylindrical shape, a tubular shape, a conical shape, a prismatic shape, a polygonal tubular shape, and a pyramidal shape. The number of projecting portions is not limited. For example, one or a plurality of projecting portions may be formed only on the central portion of the inner surface of the high-hardness portion, or one or a plurality of projecting portions may be formed on both of the central portion and its peripheral portions, respectively.

The distribution of the projecting portions can be set arbitrarily. The projecting portions can be arranged uniformly on the central portion and its peripheral portions, the projecting portions can be disposed in a greater number on the central portion than on the peripheral portions, or the projecting portions can be disposed in a greater number on the peripheral portions than on the central portion. The height of the projecting portions can also be set arbitrarily. For example, all the projecting portions can be set to the same height, the projections in the central portion can be set higher than the projecting portions in the peripheral portions, or the projecting portions in the central portion can be set higher than the projecting portions in the peripheral portions.

In addition, it is appropriate to set the proportion of the total planar area of the projecting portion(s) to the total planar area of the inner surface of the face insert to 5 to 80%, particularly 7 to 78%, and it is appropriate to set the proportion of the total cross-sectional area of the projecting portion(s) to the total cross-sectional area in the vertical cross-section of the face insert to 5 to 90%, particularly 7 to 88%.

In the aspect, particularly preferably, the projecting portion is formed on the central portion of the inner surface of the high-hardness portion and both lateral peripheral portions, and a proportion of a total planar area of the projecting portion to a planar area of the inner surface of the high-hardness portion in the central portion is set to be greater than a proportion of a total planar area of the projecting portion to the planar area of the inner surface of the high-hardness portion in the peripheral portions. Namely, in the putting, if the golf ball is hit by a peripheral portion of the face surface, the putter head vibrates greatly, and it is normally impossible to obtain a satisfactory hitting sensation. In contrast, when the total planar area of the projecting portion(s) is dense in the central portion and sparse in the peripheral portions by adopting the above-described arrangement, the hardness of the central portion of the face surface becomes high, and the hardness of the peripheral portions becomes low. For this reason, even when the golf ball is hit by a peripheral portion of the face surface, the face insert absorbs the vibration of the putter head, making it possible to obtain a satisfactory hitting sensation. In addition, since the projecting portion of the high-hardness portion is also present in the peripheral portions, it is possible to obtain a hard hitting sound.

According to the putter head in accordance with the invention, the hitting sensation at the time of hitting a ball is soft, and the hitting sound is hard, so that the sense of distance is easy to grasp.

DETAILED DESCRIPTION OF THE PREFFERED EMBODIMENTS

Hereafter, a description will be given of embodiments of the invention with reference to the drawings, but the invention is not limited to these embodiments.

First Embodiment

Figure 1:
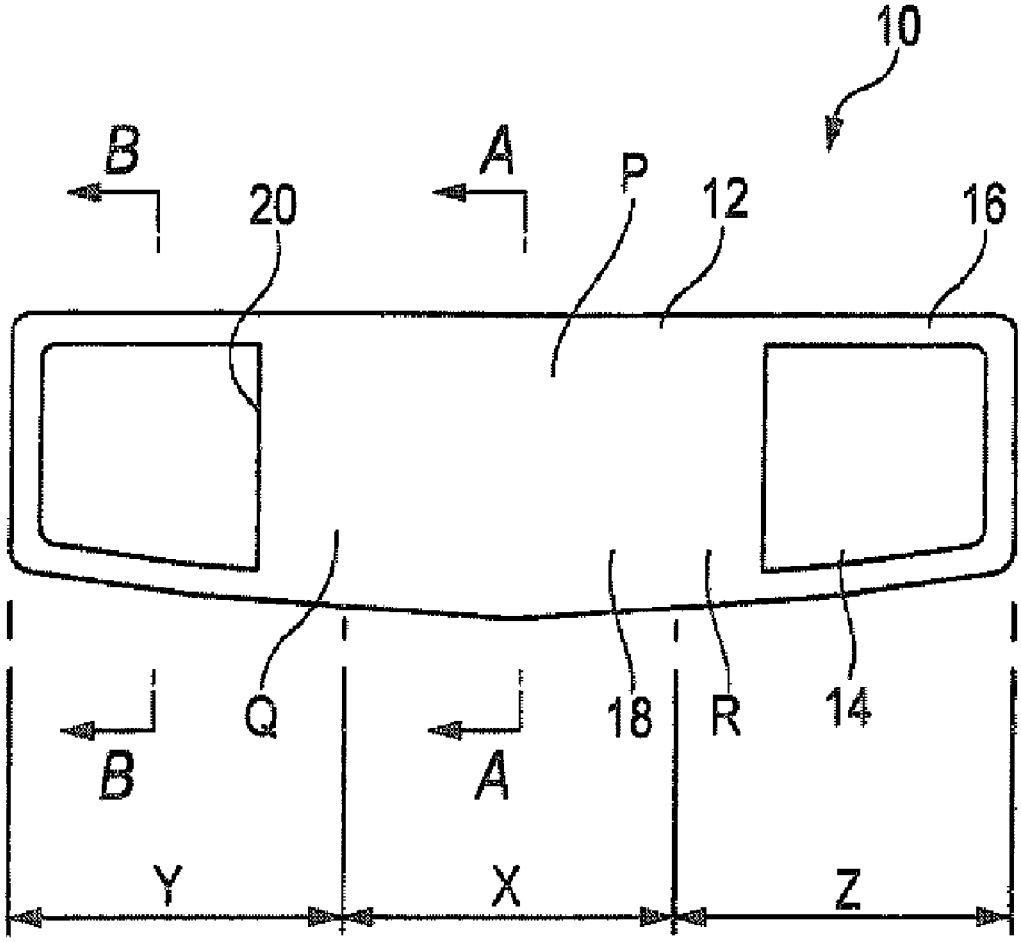
FIG. 1 is a rear view illustrating a face insert used in a putter head according to a first embodiment of the invention.
Figure 2:
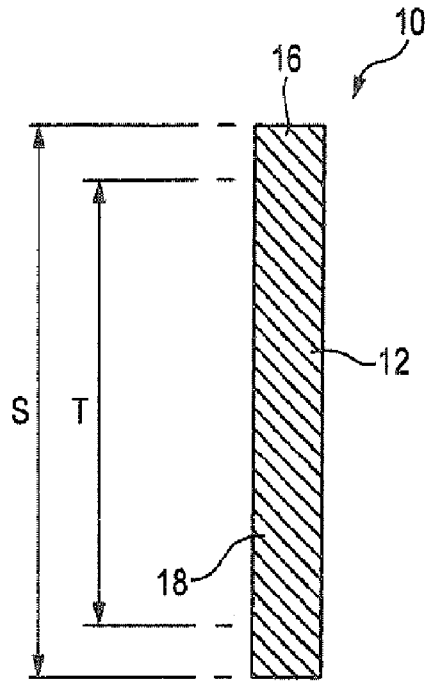
FIG. 2 is a cross-sectional view taken along line A-A in FIG. 1.
Figure 3:
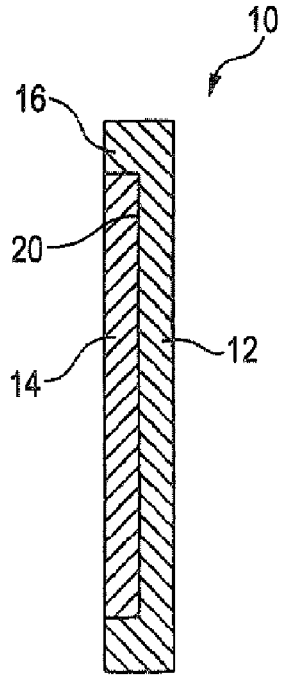
FIG. 3 is a cross-sectional view taken along line B-B in FIG. 1.
Figure 4:
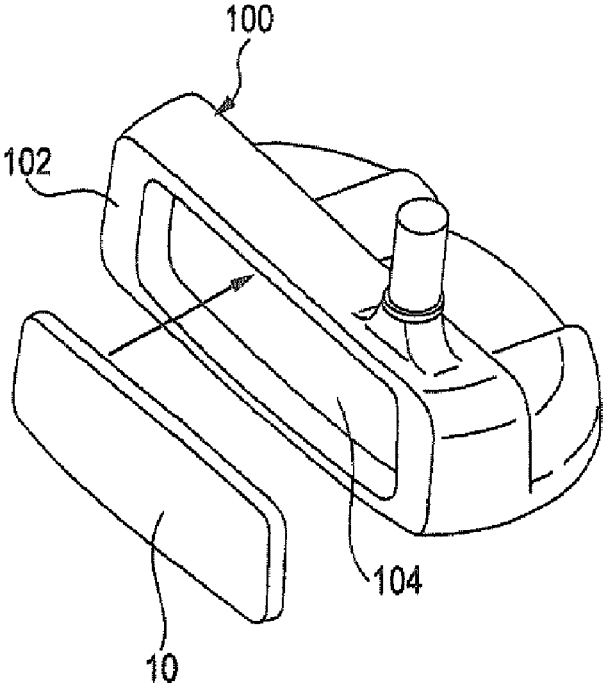
FIG. 4 is an exploded perspective view illustrating an example of a putter head with the face insert fitted therein.

FIG. 1 is a rear view illustrating a face insert used in a putter head according to a first embodiment the invention. FIG. 2 is a cross-sectional view taken along line A-A in FIG. 1. FIG. 3 is a cross-sectional view taken along line B-B in FIG. 1. A face insert 10 in accordance with this embodiment includes a high-hardness portion 12 forming a hitting surface and a pair of low-hardness portions 14 whose hardness is lower than that of the high-hardness portion 12. The face insert 10 of this embodiment includes the high-hardness portion 12 that is formed in a plate-shape. A frame-like body 16 is provided projectingly along peripheral edges of the plate-shaped high-hardness portion 12. The high-hardness portion 12 includes a projecting portion 18 having a substantially rectangular shape. The projecting portion 18 is provided such that it extends from a central portion toward its both lateral peripheral portions. The frame-like body 16 and the projecting portion 18 are formed integrally. The low-hardness portions 14 are joined to the inner surface of the high-hardness portion 12 so as to fill a pair of recessed portions 20 defined by the frame-like body 16 and the projecting portion 18. Accordingly, in the face insert 10 of this embodiment, the proportion of a planar area (surface area) P of the projecting portion 18 to a planar area (surface area) of the high-hardness portion 12 in a central portion X is greater than the proportion of a planar area Q, R of the projecting portion to the planar area of the high-hardness portion 12 in peripheral portions Y, Z. In addition, in the face insert 10 of this embodiment, the proportion of a total planar area T of the projecting portion 18 to a total planar area S of the inner surface of the face insert 10 can be set to 5 to 80%. The face insert 10 according to this embodiment is fitted in a recessed portion 104 formed in a face portion 102 of a head body 100, as shown in FIG. 4.

Second Embodiment

Figure 5:
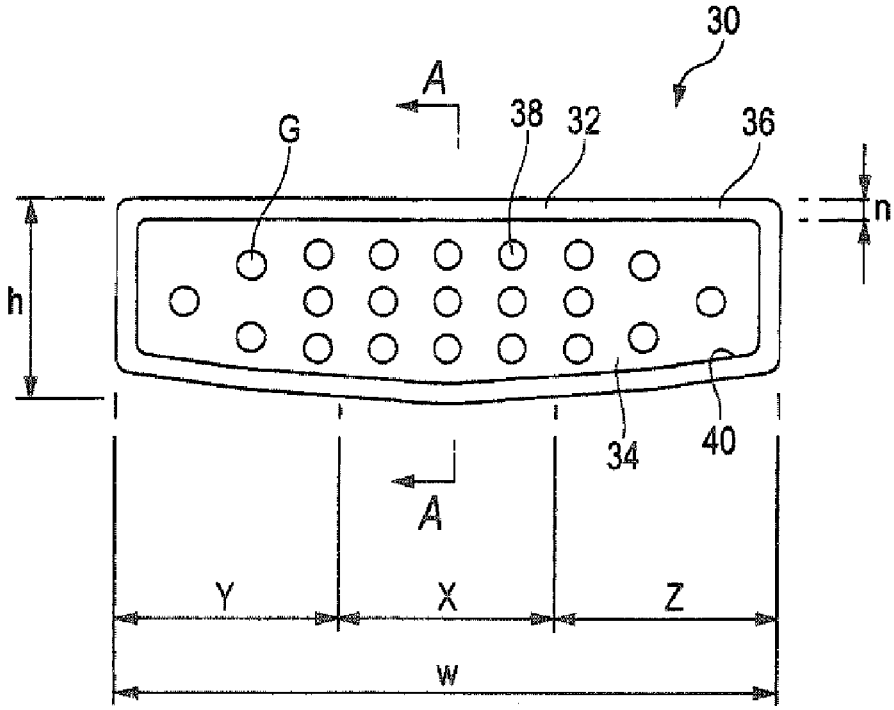
FIG. 5 is a rear view illustrating a face insert used in a putter head according to a second embodiment of the invention.
Figure 6:
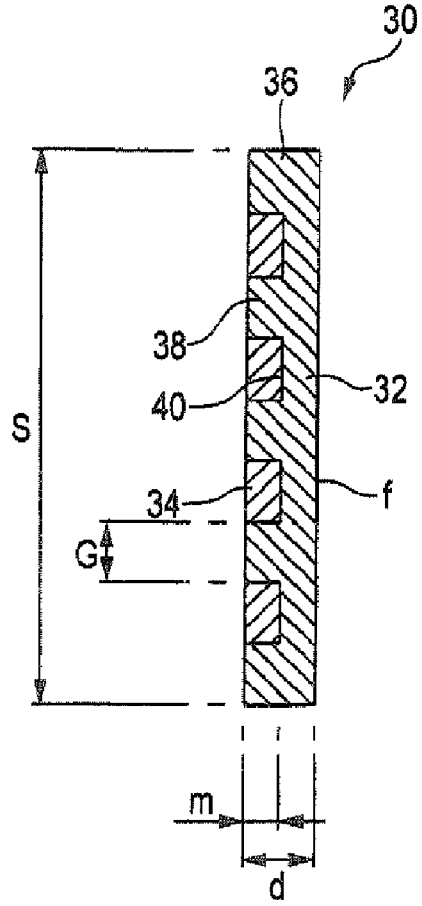
FIG. 6 is a cross-sectional view taken along line A-A in FIG. 5.

FIG. 5 is a rear view illustrating a face insert used in a putter head according to a second embodiment of the invention. FIG. 6 is a cross-sectional view taken along line A-A in FIG. 5. A face insert 30 in accordance with this embodiment includes a high-hardness portion 32 for forming the hitting surface and a low-hardness portion 34 whose hardness is lower than that of the high-hardness portion 32. In addition, in the face insert 30 of this embodiment, a frame-like body 36 is provided projectingly along peripheral edges of the plate-shaped high-hardness portion 32. Plural cylindrical projecting portions 38 are formed on the inner side of the frame-like body 36. The low-hardness portion 34 is joined to the high-hardness portion 32 so as to fill a recessed portion 40 formed by the frame-like body 36 and the projecting portions 38. In the face insert 30 of this embodiment, the proportion of a total planar area (G×9) of the projecting portions 38 to the planar area of the high-hardness portion 32 in the central portion X is made greater than the proportion of a total planar area (G×6) of the projecting portions 38 to the planar area of the high-hardness portion 32 in the peripheral portion Y, Z. Namely, 9 projecting portions 38 are disposed on the central portion X, and 6 projecting portions 38 are disposed on its both lateral peripheral portions Y and Z, respectively. In addition, in the face insert 30 of this embodiment, the proportion of a total planar area (G×21) of the projecting portions 38 to the total planar area S of the face insert 30 can be set to 5 to 80%. The use of the face insert 30 in accordance with this embodiment is similar to that of the first embodiment. Although, in the face insert 30 according to this embodiment, the thickness of the high-hardness portion 32 and the depth of the recessed portion 40 are set to be equal, the thickness of the high-hardness portion 32 may be greater than the depth of the recessed portion 40.

Third Embodiment

Figure 7:
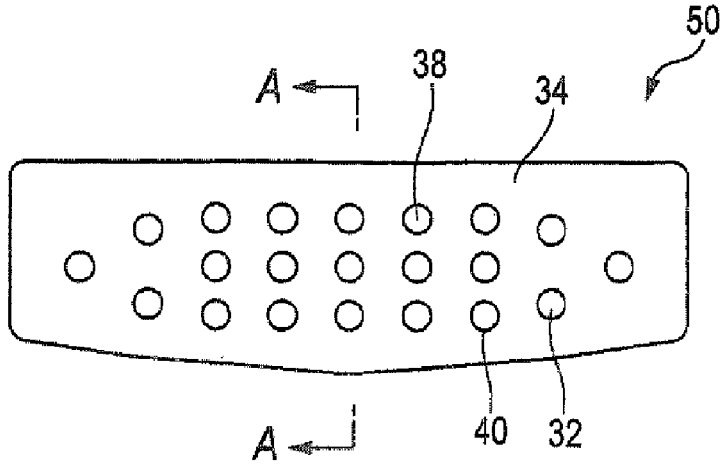
FIG. 7 is a rear view illustrating a face insert used in a putter head according to a third embodiment of the invention.
Figure 8:
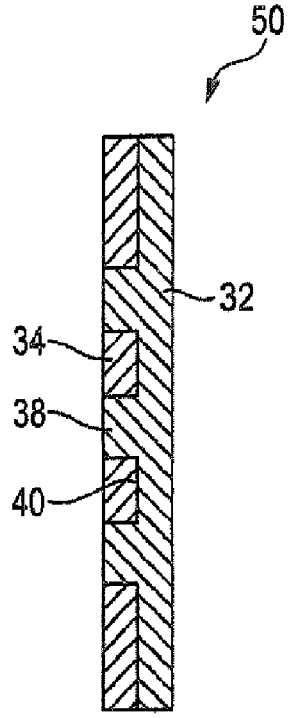
FIG. 8 is a cross-sectional view taken along line A-A in FIG. 7.

FIG. 7 is a rear view illustrating a face insert used in a putter head according to a third embodiment of the invention. FIG. 8 is a cross-sectional view taken along line A-A in FIG. 7. A face insert 50 in accordance with this embodiment is almost the same as the second embodiment except that the frame-like body is not provided projectingly on the peripheral edges of the plate-like high-hardness portion 32. In FIGS. 7 and 8, the same component portions as those shown in FIGS. 5 and 6 are denoted by the same reference numerals, and a description thereof is omitted herein.

Fourth Embodiment

Figure 9:
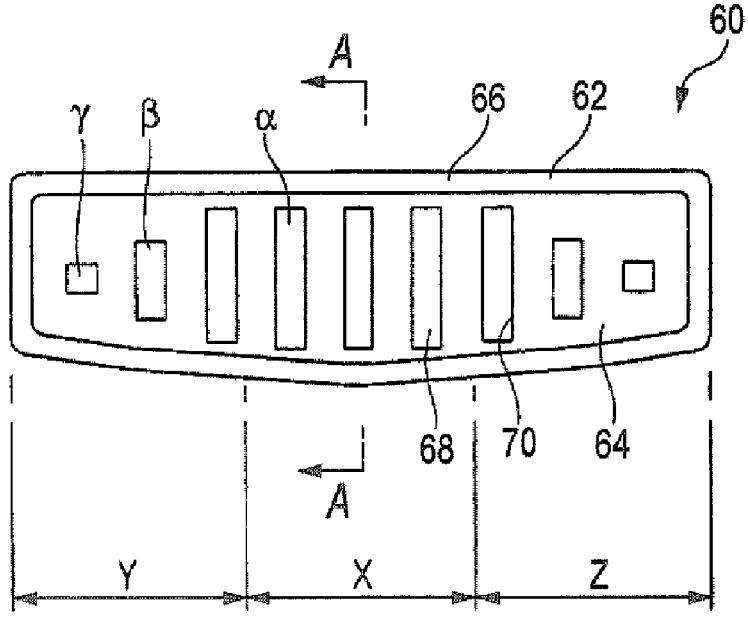
FIG. 9 is a rear view illustrating a face insert used in a putter head according to a fourth embodiment of the invention.
Figure 10:
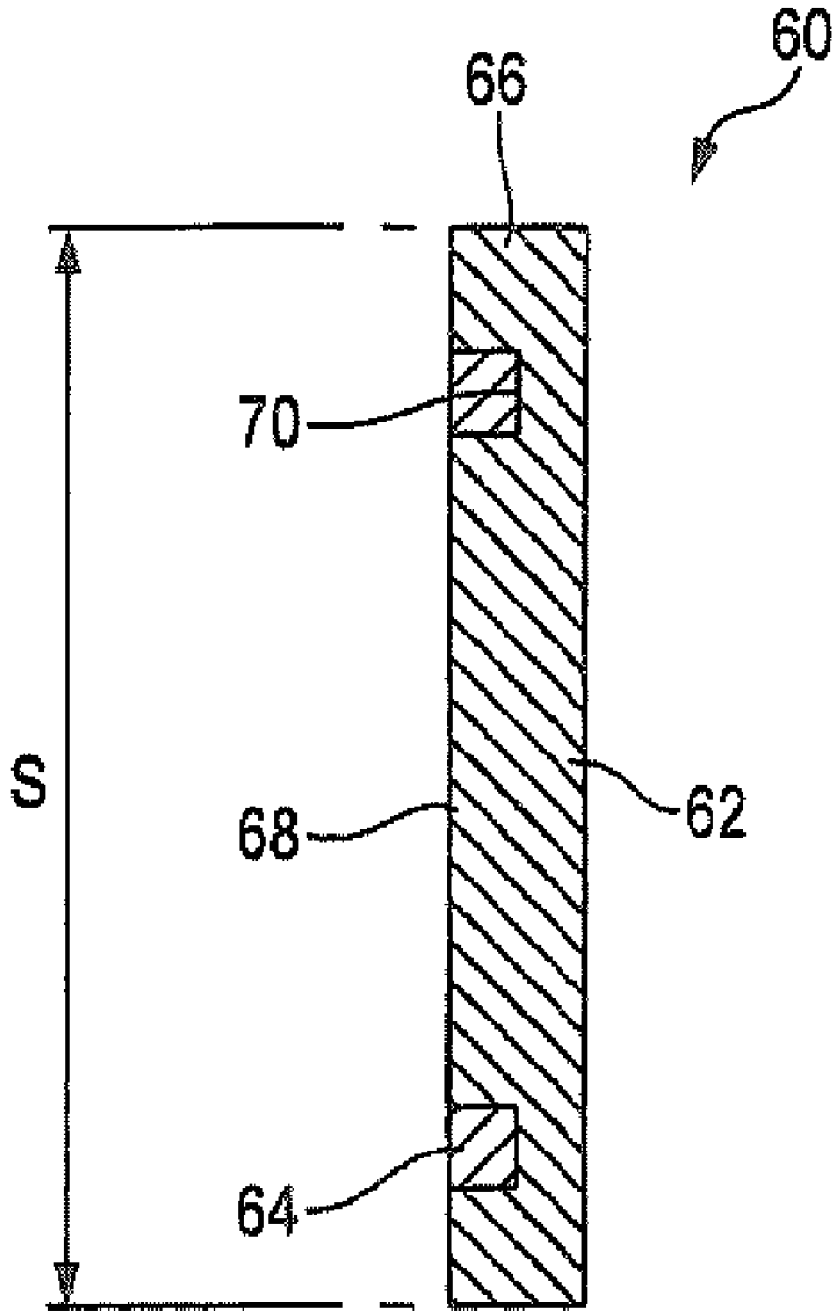
FIG. 10 is a cross-sectional view taken along line A-A in FIG. 9.

FIG. 9 is a rear view illustrating a face insert used in a putter head according to a fourth embodiment of the invention. FIG. 10 is a cross-sectional view taken along line A-A in FIG. 9. A putter head 60 in accordance with this embodiment includes a high-hardness portion 62 for forming the hitting surface and a low-hardness portion 64 whose hardness is lower than that of the high-hardness portion 62. In addition, in the face insert 60 of this embodiment, a frame-like body 66 is formed along peripheral edges of the plate-shaped high-hardness portion 62. Plural quadrangular prism-shaped projecting portions 68 are formed on the inner side of the frame-like body 66. The low-hardness portion 64 is joined to the high-hardness portion 62 so as to fill a recessed portion 70 formed by the frame-like body 66 and the projecting portions 68. In the face insert 60 of this embodiment, the proportion of a total planar area ($\alpha\times3$) of the projecting portions 68 to the planar area of the high-hardness portion 62 in the central portion X is made greater than the proportion of a total planar area ($\alpha+\beta+\gamma$) of the projecting portions 68 to the planar area of the high-hardness portion 62 in the peripheral portion Y, Z. Namely, 3 projecting portions 68 having large planar areas are disposed on the central portion, and the projecting portions 68 whose planar areas are large, medium, and small are disposed on each of lateral peripheral portions. In addition, in the face insert 60 of this embodiment, the proportion of a total planar area ($5\alpha+2\beta+2\gamma$) of the projecting portions 68 to the total planar area S of the face insert 60 can be set to 5 to 80%. The use of the face insert 60 in accordance with this embodiment is similar to that of the first embodiment. Although, in the face insert 60 in accordance with this embodiment, the thickness of the high-hardness portion 62 and the depth of the recessed portion 70 are set to be equal, the thickness of the high-hardness portion 62 may be greater than the depth of the recessed portion 70.

EXAMPLE

A putter was fabricated by using a putter head in which the face insert 30 in accordance with the second embodiment shown in FIGS. 5 and 6 was fitted in the head body 100 shown in FIG. 4. In this case, an aluminum alloy was used as the material of the head body; a urethane resin (Shore D hardness: 60) as the material of the high-hardness portion 32; a urethane resin (Shore D hardness: 40) as the material of the low-hardness portion 34; and steel as the material of the shaft. In addition, the height h of the face insert 30 was set to 20 mm; the width w, 70 mm; the thickness d, 4 mm; the height m of the frame-like body 36 and the cylindrical projecting portion 38, 2 mm; the width n of the frame-like body 36, 2 mm; the diameter of the cylindrical projecting portion 38, 3 mm, the area of the face surface f (the same as the total planar area of the face insert 30), approximately 1290 $mm^2$; and the total planar area (G×21) of the cylindrical projecting portion 38, approximately 150 $mm^2$.

Next, putting was performed by using the putter (embodiment) obtained, and the hitting sensation and the hitting sound were evaluated. As the golf balls, Tourstage X-01 manufactured by BRIDGESTONE SPORTS CO., LTD. was used. In addition, by way of comparison, similar tests were conducted by using a putter (comparison 1) similar to that of the embodiment except that a recessed portion was not provided in the head body and the face insert was not fitted, a putter (comparison 2) similar to that of the embodiment except that a face insert having a single-layer structure made of a urethane resin (Shore D hardness: 25) was used as the face insert, and a putter (comparison 3, the difference in the Shore D hardness between the high-hardness portion and the low-hardness portion being less than 5) similar to that of the embodiment except that a urethane resin with a Shore D hardness of 60 was used for the high-hardness portion, and that a urethane resin with a Shore D hardness of 56 was used for the low-hardness portion. The evaluation of the hitting sensation and the hitting sound was made on the basis of sensory evaluation by a plurality of golfers. The results are shown in Table 1.

TABLE 1

| | Hitting Sensation | Hitting Sensation | Sense of Distance |
|---|---|---|---|
| Embodiment | Soft | Hard (high) | Easy to grasp |
| Comparative Example 1 | Hard | Hard (high) | Easy to grasp |
| Comparative Example 2 | Soft | Dull (low) | Difficult to grasp |
| Comparative Example 3 | Hard | Hard (high) | Easy to grasp |

From the results of Table 1, it was confirmed that, as for the putter head in accordance with the embodiment of the invention, the hitting sensation at the time of hitting the ball is soft, and the hitting sound is hard, so that the sense of distance is easy to grasp. In addition, with the putter of the embodiment, even in cases where the golf ball was hit at a peripheral portion of the face surface, it was possible to obtain a satisfactory hitting sensation and a hard hitting sound.

What is claimed is:

1. A putter head comprising:

a head body having a face portion; and a face insert fitted in the face portion, the face insert including a high-hardness portion that forms a hitting surface, a low-hardness portion joined to the high-hardness portion and having a hardness lower than that of the high-hardness portion, and a projecting portion formed at least on a central portion of the high-hardness portion, the low-hardness portion filling a recessed portion formed by the projecting portion, wherein the low-hardness portion is joined to the high hardness portion at a surface of the face insert opposite the hitting surface, wherein the projecting portion is formed on the central portion of the high-hardness portion and both lateral peripheral portions of the high-hardness portion, and a proportion of a total planar area of the projecting portion to a planar area of the high-hardness portion in the central portion is greater than a proportion of a total planar area of the projecting portion to the planar area of the high-hardness portion in the peripheral portions.

2. The putter head according to claim 1, wherein the proportion of the total planar area of the projecting portion to the total planar area of the face insert is 5 to 80%.

3. The putter head according to claim 1, wherein the Shore D hardness of the high-hardness portion is 30 or more, the Shore D hardness of the low-hardness portion is 10 or more, and the difference in the Shore D hardness between the high-hardness portion and the low-hardness portion is 5 or more.

4. The putter head according to claim 1, wherein at least one of the high-hardness portion and the low-hardness portion is formed of an elastomer.

5. The putter head according to claim 4, wherein the face insert is formed separately from the head body.

6. The putter head according to claim 1, wherein at least one of the high-hardness portion and the low-hardness portion is formed of a urethane resin.

7. The putter head according to claim 6, wherein the face insert is formed separately from the head body.

8. The putter head according to claim 1, wherein the face insert defines substantially all of the hitting surface of the putter head.

9. The putter head according to claim 1, wherein all of the hitting surface of the face insert is formed of the high-hardness portion.

10. The putter head according to claim 1, wherein both the high-hardness portion and the low-hardness portion are formed of at least one of: a synthetic resin or a rubber.

11. The putter head according to claim 10, wherein the face insert is formed separately from the head body.

12. The putter head according to claim 1, wherein at least one of the high-hardness portion and the low-hardness portion is formed of at least one of: a synthetic resin or a rubber.

13. The putter head according to claim 12, wherein the face insert is formed separately from the head body.

14. A putter head comprising:

a head body having a face portion; and a face insert fitted in the face portion, the face insert including a high-hardness portion that forms a hitting surface, a low-hardness portion joined to the high-hardness portion and having a hardness lower than that of the high-hardness portion, and a projecting portion formed at least on a central portion of the high-hardness portion, the low-hardness portion filling a recessed portion formed by the projecting portion, wherein the projecting portion is formed on the central portion of the high-hardness portion and both lateral peripheral portions of the high-hardness portion, and a proportion of a total planar area of the projecting portion to a planar area of the high-hardness portion in the central portion is greater than a proportion of a total planar area of the projecting portion to the planar area of the high-hardness portion in the peripheral portions.

15. The putter head according to claim 14, wherein the proportion of the total planar area of the projecting portion to the total planar area of the face insert is 5 to 80%.

* * * * *